US008225775B1

(12) United States Patent
Idogawa et al.

(10) Patent No.: US 8,225,775 B1
(45) Date of Patent: Jul. 24, 2012

(54) IGNITION COIL DEVICE

(75) Inventors: Takashi Idogawa, Tokyo (JP); Takeshi Shimizu, Tokyo (JP); Nobuyuki Sawazaki, Tokyo (JP); Tomohito Matsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/204,153

(22) Filed: Aug. 5, 2011

(51) Int. Cl.
*H01F 38/12* (2006.01)
*H01F 27/02* (2006.01)

(52) U.S. Cl. ..... 123/634

(58) Field of Classification Search ..... 123/634, 123/635

See application file for complete search history.

(56) References Cited

U.S. PATENT DOCUMENTS

| | | | | |
|---|---|---|---|---|
| 2,665,673 | A * | 1/1954 | Woofter | 439/125 |
| 3,597,723 | A * | 8/1971 | Schmidt et al. | 439/125 |
| 3,793,616 | A * | 2/1974 | Moehrke | 439/854 |
| 4,859,194 | A * | 8/1989 | Bartholomew | 439/125 |
| 5,357,233 | A * | 10/1994 | Wada | 336/107 |
| 6,273,733 | B1 * | 8/2001 | Uchiyama | 439/125 |
| 6,857,420 | B2 | 2/2005 | Weimert | |
| 7,681,563 | B2 | 3/2010 | Idogawa et al. | |
| 2008/0271724 | A1 * | 11/2008 | Idogawa et al. | 123/634 |

FOREIGN PATENT DOCUMENTS

| | | | |
|---|---|---|---|
| DE | 4134274 | A1 | 4/1930 |
| DE | 19831196 | A1 | 1/2000 |
| DE | 10304138 | B3 | 7/2004 |
| JP | 05-052175 | A | 3/1993 |
| JP | 5-03467 | U | 4/1993 |
| JP | 11-026267 | A | 1/1999 |
| JP | 2000-110698 | A | 4/2000 |
| JP | 2000-277746 | A | 10/2000 |
| JP | 2004-22481 | A | 1/2004 |
| JP | 2008-274880 | A | 11/2008 |
| JP | 4267042 | B2 | 11/2008 |

* cited by examiner

*Primary Examiner* — Erick Solis
(74) *Attorney, Agent, or Firm* — Sughrue Mion, PLLC

(57) ABSTRACT

In an ignition coil device mainly mounted in an internal combustion engine, the installation can be improved even in an ignition coil having a bent leading end. The ignition coil device of a bent type includes a case having a transformer structure with a primary coil and a secondary coil therein; a high voltage tower including a high voltage terminal that transmits a high voltage developed in the secondary coil to a lower portion of the case; and a plug boot that electrically and mechanically connects the high voltage terminal, the high voltage tower to an ignition plug, includes a boot base close to the high voltage tower and a boot leading end close to the ignition plug in which a center axis of the high voltage tower and a center axis of the boot leading end are tilted, wherein a bend position is set in the vicinity of an intersection point of the center axis of the high voltage tower and the center axis of the boot leading end, and a rigid intermediate member including a connection relay member that electrically connects the high voltage terminal and the ignition plug is provided, and the rigid intermediate member extends from the boot base to the bend position.

7 Claims, 5 Drawing Sheets

IGNITION COIL DEVICE

BACKGROUND OF THE INVENTION

1. Field of the Invention

The present invention relates to an ignition coil device that is mainly fitted to an internal combustion engine, and applies a high voltage to an ignition plug to generate spark discharge, and more particularly to an ignition coil device of a bent type in which an ignition plug center axis is not linear but tilted with respect to a center axis of a high voltage terminal.

2. Background Art

In recent years, with complicated and downsized structure of an upper portion of each cylinder head in an internal combustion engine, a downsized combustion chamber, application of a structure in which plural plugs are arranged in one cylinder and ignited and the like, there is an ignition coil device in which a center axis of the ignition plug is not linear but tilted with respect to the center axis of the high voltage terminal of an ignition coil.

When the ignition coil device having the above structure is mounted, bent ignition coils must be used, and there is a need to improve the installation, particularly workability for inserting the ignition coil into a plug hole.

CITATION LIST

Patent Literature

Patent Literature 1: JP-4267042

In a device disclosed in Patent Literature 1, although the ignition coil device is linear, a bend position is predetermined, and the device per se is bent according to the degree of bending for installation. However, the installation of the ignition coil and the attachment and detachment for maintenance may be low depending on a positional relationship of the plug hole. An internal combustion engine in which an inlet of the plug hole is largely opened is hardly problematic, but in an internal combustion engine having no large opening, tools cannot be used, and the securement of the workability is an important issue. Also, when the plug is inserted into the plug hole, the plug may be deformed in the vicinity of bending of the a plug boot or at a leading end of the plug boot, thereby making it difficult to insert the plug into the plug hole.

SUMMARY OF THE INVENTION

The present invention has been made to solve the above problem, and aims at providing a device that does not impair the insertion property even if the coil is bent.

According to the present invention, there is provided an ignition coil device of a bent type including: a case having a transformer structure with a primary coil and a secondary coil therein; a high voltage tower including a high voltage terminal that transmits a high voltage developed in the secondary coil to a lower portion of the case; and a plug boot that electrically and mechanical connects the high voltage terminal, the high voltage tower to an ignition plug, includes a boot base close to the high voltage tower and a boot leading end close to the ignition plug in which a center axis of the high voltage tower and a center axis of a boot leading end are tilted, wherein a bend position is set in the vicinity of an intersection point of the center axis of the high voltage tower and the center axis of the boot leading end, and a rigid intermediate member including a connection relay member that electrically connects the high voltage terminal and the ignition plug is provided, and the rigid intermediate member extends from the boot base to the bend position.

According to the ignition coil device of the present invention, since the insertion force can be exerted directly on the device leading end when inserting the plug into the plug hole, the insertion property can be improved.

The foregoing and other object, features, aspects and advantages of the present invention will become more apparent from the following detailed description of the present invention when taken in conjunction with the accompanying drawings.

DETAILED DESCRIPTION OF THE PREFERRED EMBODIMENTS

First Embodiment

Hereinafter, embodiments of the present invention will be described with reference to the accompanying drawings. In the respective drawings, the same or corresponding members and portions are denoted by identical reference symbols for description.

Figure 1:
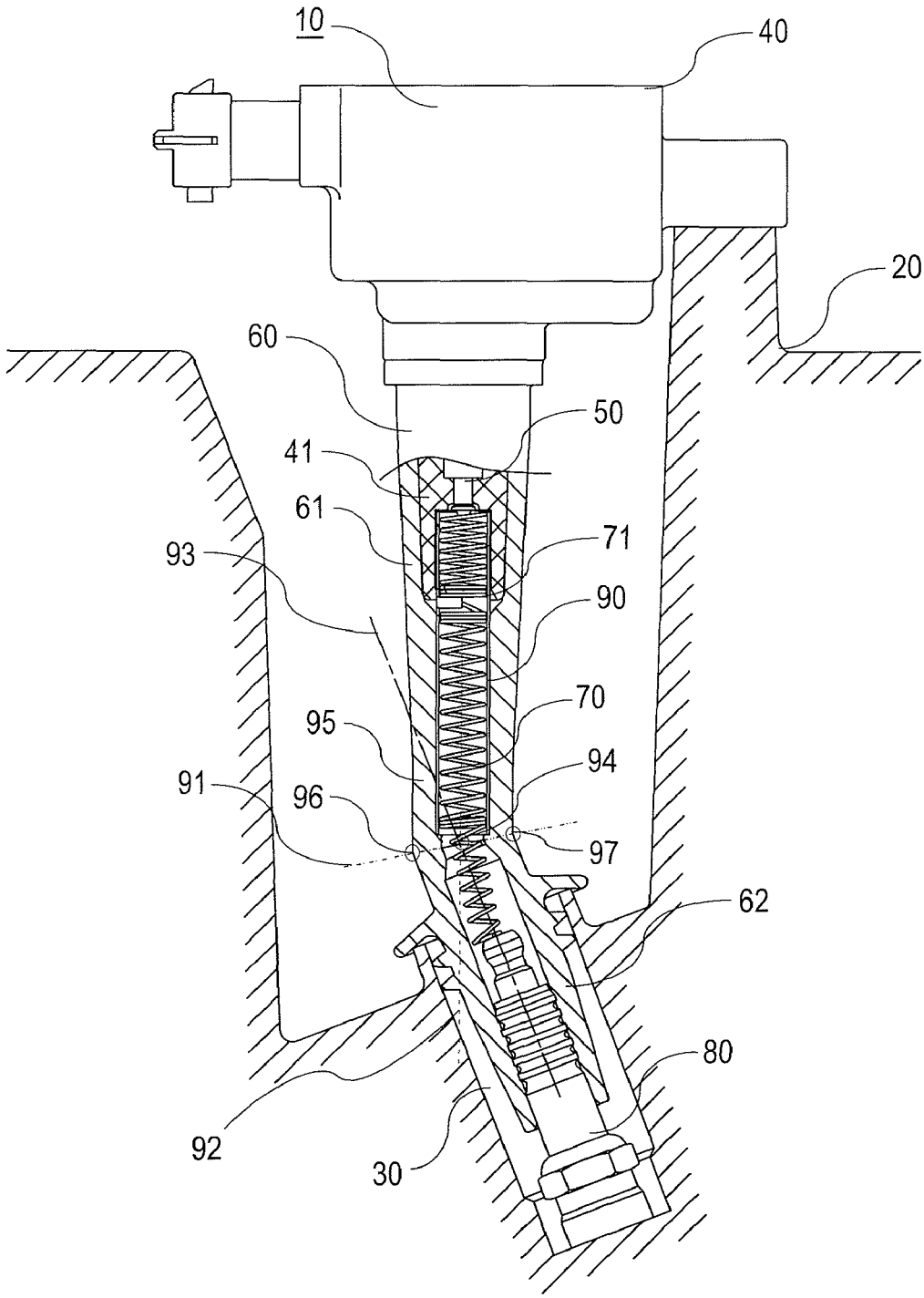
FIG. 1 is a diagram illustrating an overall configuration of an ignition coil device according to a first embodiment of the present invention.

FIG. 1 is a diagram illustrating an overall configuration of an ignition coil device according to a first embodiment of the present invention, which illustrates an ignition coil device 10 installed on a cylinder head 20 of an internal combustion engine. An insulating case 40 includes, for example, a transformer structure having a primary coil, a secondary coil, and a magnetic core that electrically couples the primary and secondary coils with each other, and a control circuit that controls a current in the primary coil therein. A high voltage developed in the secondary coil upon interruption of a primary coil current on the basis of a control signal from an engine controller (not shown) is transmitted to a high voltage terminal 50 disposed in a high voltage tower 41 projected from a bottom of the insulating case 40. Also, both of the high voltage tower 41 and an ignition plug 80 are coupled to each other by a plug boot 60. In particular, the plug boot 60 that covers the ignition plug 80 and extends from a bend position 91 toward an end thereof (downward in the figure) is called "boot leading end 62". The plug boot 60 that extends from the high voltage tower 41 to the bend position 91 is called "boot base 61". Also, the plug boot 60 includes a sleeve 90 that is a rigid intermediate member, a spring 70 that is an electrically conductive connection relay member mainly for the purpose of an electric connection therein, and an exterior boot 95 having flexibility higher than that of the high voltage tower 41.

The high voltage terminal 50 is connected to the ignition plug 80 through the spring 70 having the electrical conductivity and flexibility. With this configuration, the high voltage developed in the secondary coil is transmitted to the ignition plug, and spark ignition can be conducted within a cylinder of the internal combustion engine. On the other hand, the sleeve 90 mechanically connects the boot base 61 and the high voltage tower 41. In an inner diameter of the sleeve 90, at least a neighborhood of the bend position is made equivalent to an outer diameter of the spring 70, thereby enabling a deformation of the spring caused by a force applied in inserting the ignition coil device 10 into a plug hole 30 and a reduction in the amount of compression attributable to the deformation to be suppressed. Also, the spring 70 can be made of, for example, metal which is an electrically conductive material, thereby improving a suppression of electromagnetic noise and an improvement in the conductivity. An upper portion (upper side in FIG. 1) of the sleeve 90 substantially extends from the high voltage terminal 50, and a lower end of the sleeve 90 substantially extends to the bend position 91.

The bend position 91 passes through an intersection point 94 between a center axis 92 of the high voltage tower 41 and a center axis 93 of the boot leading end, and connects bent points 96 and 97 of the exterior boot 95. Because the sleeve 90 that is the rigid intermediate member extends to the bend position 91, the boot base 61 is not bent and deformed even if the ignition coil is inserted by application of a force, and can receive an insertion force from an upper portion of the ignition coil. Therefore, the insertion property is improved. Also, a lower leading end of the sleeve 90 can be tilted equally to a surface of the bend position 91 unlike FIG. 1. When the sleeve leading end is thus tilted, attention must be paid to a direction of inserting the sleeve into the boot base 61. On the other hand, when the sleeve leading end is a horizontal leading end surface, the inserting direction can be arbitrary.

The spring 70 has coarse and dense portions. A portion of the spring 70 extending from the bend position downward is made coarse, thereby ensuring the flexibility of the spring per se. Also, an upper portion of the bend position is made dense whereby the spring 70 can be arranged and fixed at that position. Further, this configuration has an effect of regulating the amount of compression at this position once. Further, in order that the connection of the spring 70 to the high voltage terminal 50 may be ensured, and an upper end of the spring may be positioned, the upper portion of the bend position is made dense. Alternatively, it is possible that the upper portion is made coarse as with the lower end, a spring intermediate portion 71 is made dense, and the spring is compressed at a time when the high voltage terminal 50 is installed. With a structure in which the upper and lower ends are coarse, and the intermediate portion is dense, the spring is vertically symmetrical, and an erroneous upside-down arrangement during assembling can be eliminated.

Figure 2:
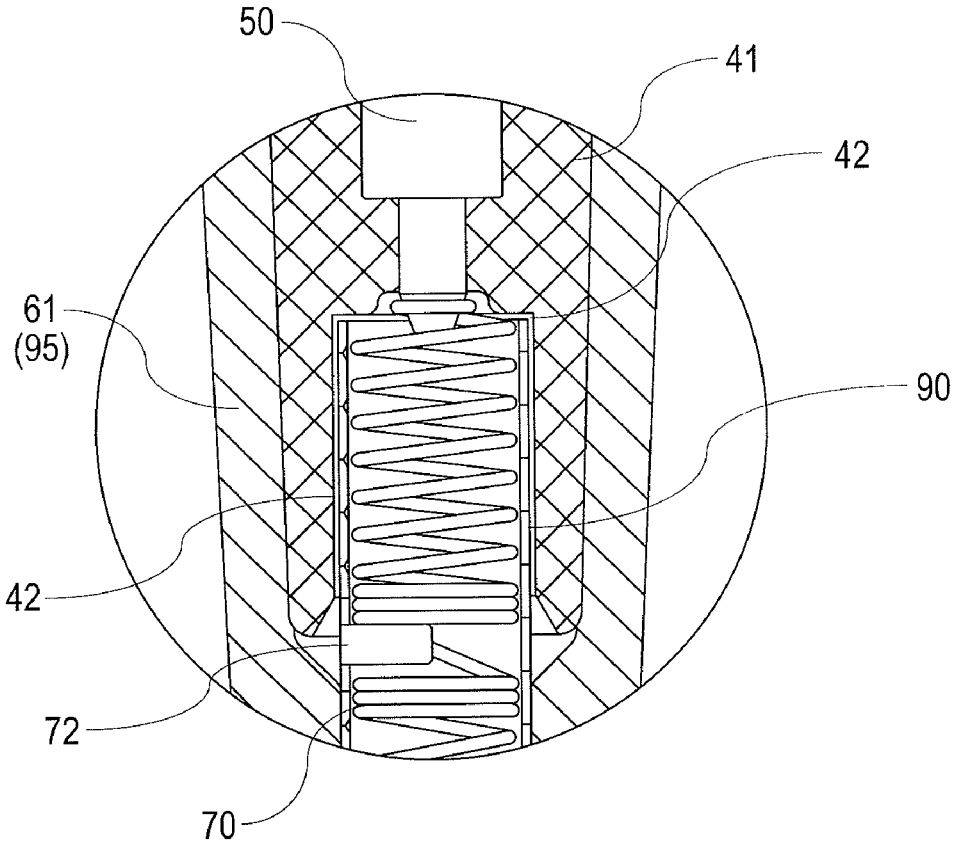
FIG. 2 is a partially enlarged diagram of the ignition coil device according to the first embodiment of the present invention.

FIG. 2 is an enlarged diagram of the high voltage tower 41, which illustrates a positional relationship between the sleeve 90 and the high voltage tower 41. The high voltage tower 41 is an insulating member, but hard unlike the exterior boot 95 of the boot base 61. The sleeve 90 is a rigid body for mechanical connection, and is inserted into the high voltage tower 41. In order to prevent the high voltage tower 41 from being broken during inserting the sleeve 90 into the high voltage tower 41, during inserting the overall ignition coil device into the plug hole, or during vibration of the internal combustion engine, a structure having a slight gap 42, for example, about 0.1 mm between the sleeve 90 and the high voltage tower 41 is desired. On the other hand, a gap between the boot base 61 and the sleeve 90 is not required if the exterior boot 95 of the boot base 61 is made of a flexible or elastic material.

The spring 70 that is the connection relay member needs to be electrically connected to the high voltage terminal 50, and ensures a contact property by the aid of an elastic force of the spring. A retentive portion 72 is inserted into a part of the spring 70 in the vicinity of the high voltage terminal 50, and regulates the position of the spring. As a result, an elastic force between the retentive portion 72 and the high voltage terminal 50 is ensured.

Also, when the high voltage tower 41 and the plug boot 60 are separate, the insulating case 40, the high voltage tower 41, and the high voltage terminal 50 can be shared even in the ignition coils variously different in refractive index. That is, specification different in the refractive index due to a difference in the internal combustion engine or the shape of a cylinder, or different in a length to the bend position or from the bend position is perceivable. However, the upper portion (case, high voltage tower, high voltage terminal) of the ignition coil can be shared, and can be combined with a structure in which the plug boot located below the upper portion thereof conforms to various specifications.

Second Embodiment

Figure 3:
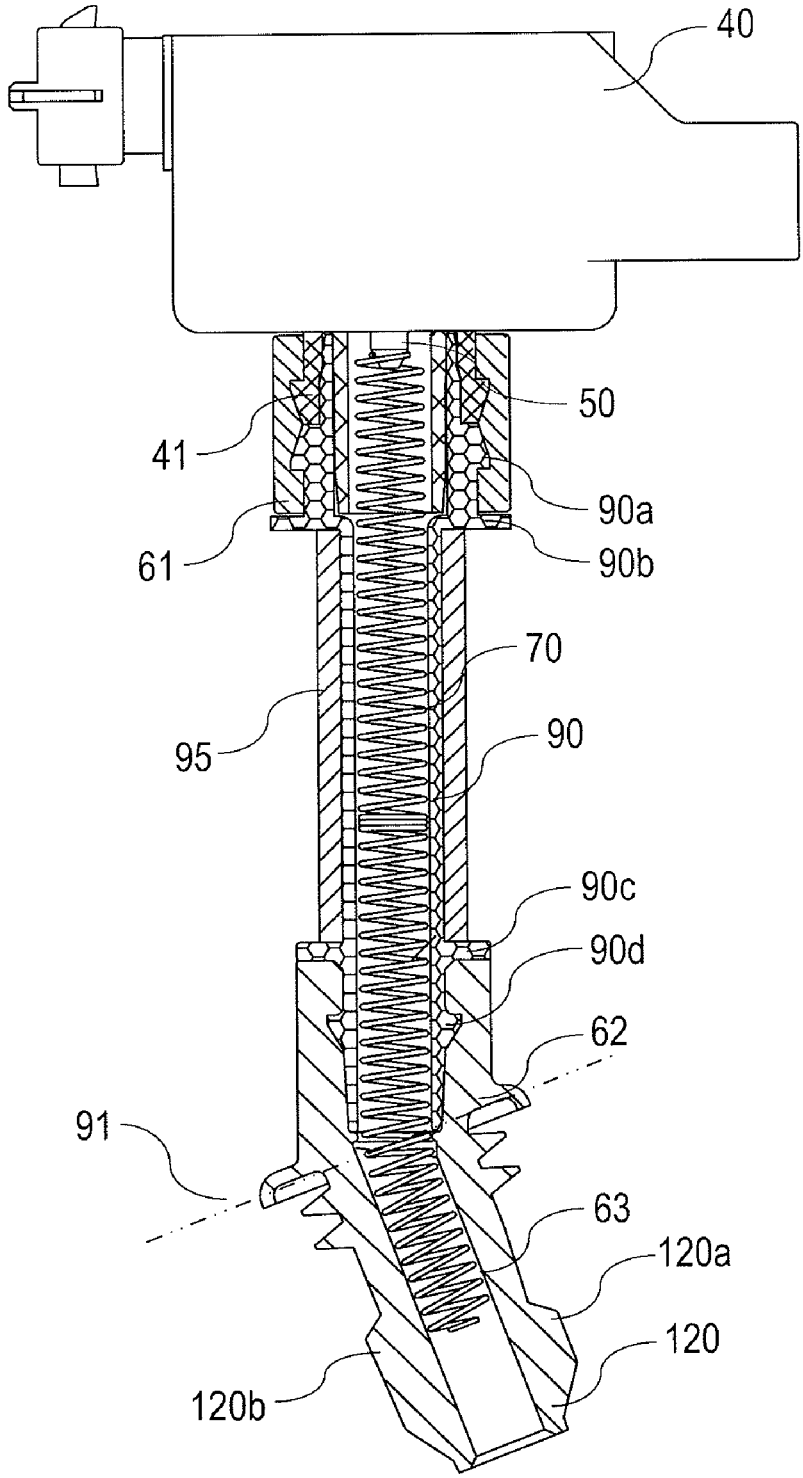
FIG. 3 is a diagram illustrating an overall configuration of an ignition coil device according to a second embodiment of the present invention.

FIG. 3 illustrates an ignition coil device according to a second embodiment of the present invention. Differences from FIG. 1 reside in that the plug boot is divided into three pieces (portions 61, 62, and an intermediate portion therebetween); the boot leading end 62 has a cap portion 120 at a tip thereof; and an inner diameter of a portion in which the spring 70 that extends from the bend position 91 to the upper side in the figure, and also is disposed in the cap portion 120 is disposed is substantially equal to an outer diameter of the spring 70. In this boot leading end 62, because the spring 70 that extends from the bend position 91 to the lower side is bend, the center axis cannot be positioned. Under the circumstances, the inner diameter of the boot leading end 62 is set to be substantially equal to the outer diameter of the spring, or slightly larger so that the spring 70 can be positioned.

Another difference from FIG. 1 resides in that plural insertion ribs (120*a*, 120*b*) are disposed on a tip of the boot leading end 62. Those insertion ribs can function as a guide for inserting the boot leading end 62 into the plug hole. Further, the tips of the insertion ribs and the cap portion 120 are wedge-shaped so that the insertion of the boot leading end 62 into the plug hole is further improved. In particular, the insertion rib 120*b* located outside in the bending direction is equal to or thicker, or longer than the inside insertion rib 120*a* so that the outside of the bent portion is not deformed even when receiving an external force at insertion. Even if the outside insertion rib has the same shape as that of the inside insertion rib, the number of the outside insertion ribs can be increased for preventing the deformation.

Also, because the plug boot is divided into three pieces, there is a need to maintain the sleeve 90. For that reason, the sleeve 90 is molded with a hard resin having plural projections 90*a* to 90*d*. The upper portion is maintained by the boot base 61 together with the high voltage tower 41 by the aid of the two projections 90*a* and 90*b*. Likewise, the lower portion is also positioned and maintained by installation of the boot leading end by the aid of the two projections 90*c* and 90*d*. The sleeve 90 can contribute to the suppression of electromagnetic noise by addition of an electrically conductive material.

On the other hand, the spring 70 has coarse and dense portions as in FIG. 1. At least the bent portion is coarsely arranged. Also, the bend position can be mainly regulated vertically asymmetrically for assembling.

In FIG. 3, the exterior boot 95 that covers the sleeve 90 is provided, and the upper and lower portions contact the boot base 61 and the boot leading end 62 through the sleeve projections 90*b* and 90*c*, respectively. In particular, there is no need to make the exterior boot 95 rigid since the sleeve 90 is rigid, and rather it is desirable that the exterior boot 95 is made of an elastic and heat-resistant material. Also, the sleeve 90 and the exterior boot 95 can be formed not separately but integrally, or by one member.

As illustrated in FIG. 3, in the structure where the plug boot is divided into the upper portion, the center portion, and the lower portion, the upper portion or the center portion can be shared according to the specification of the internal combustion engine, and the center portion or the lower portion can conform to the respective specifications, which is excellent in general purpose.

Third Embodiment

Figure 4:
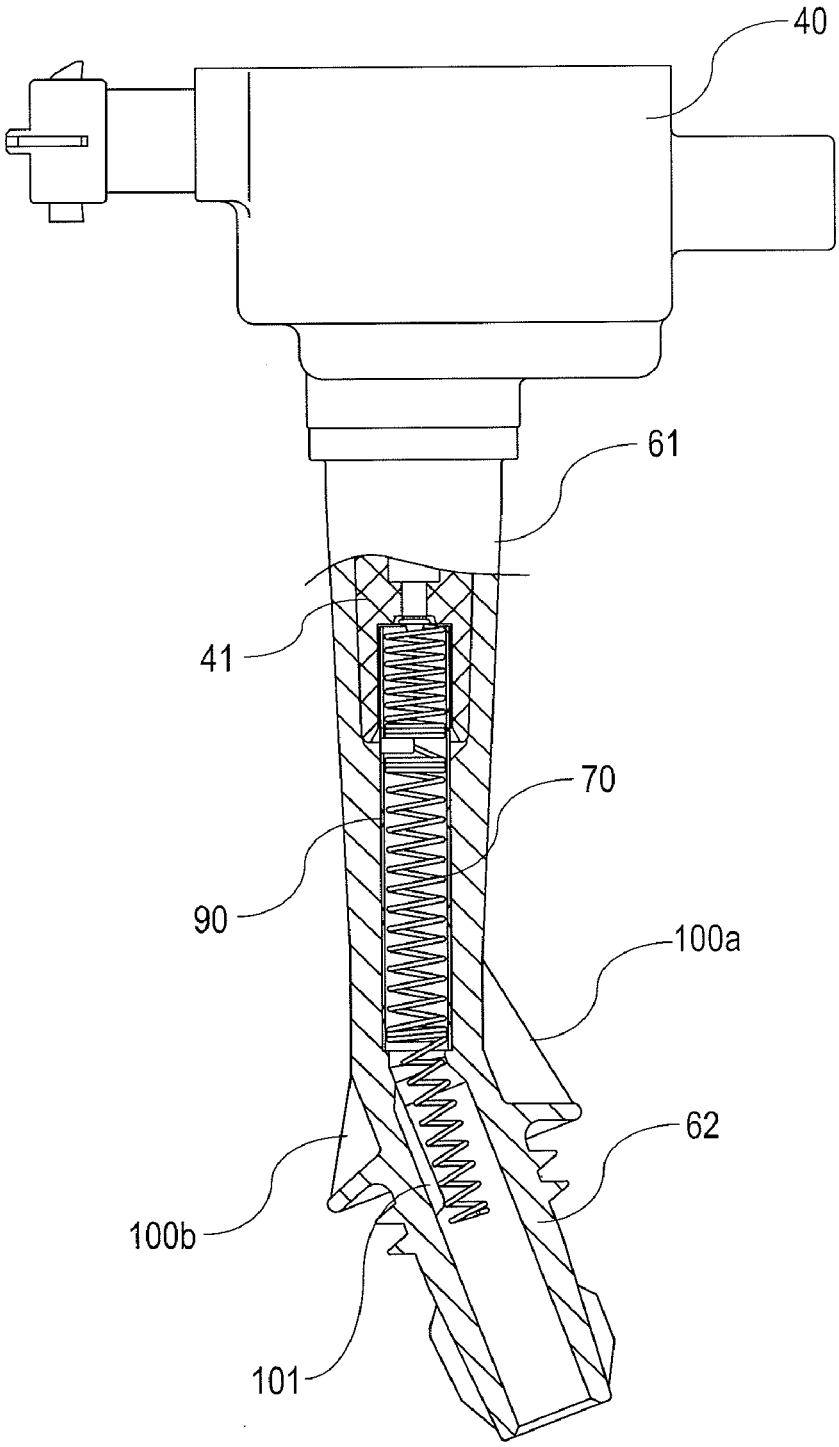
FIG. 4 is a diagram illustrating an overall configuration of an ignition coil device according to a third embodiment of the present invention.

FIG. 4 illustrates an ignition coil device according to a third embodiment of the present invention. Reinforcement ribs 100*a* and 100*b* are disposed on an exterior in the vicinity of the bend position of the boot leading end 62. Since a force exerted in inserting the ignition coil into the plug hole is concentrated on the bent portion, the deformation is prevented by the reinforcement ribs 100*a* and 100*b* so that the insertion force can be directly received. For that reason, the reinforcement ribs are preferably disposed in plurality. Furthermore, when it cannot be visually confirmed whether the ignition coil could be inserted to a given position, or not, there is a risk that the ignition coil is continuously pushed by a strong insertion force. Even in this case, the reinforcement ribs can address the concentration of the force on the bend position. Further, the internal combustion engine generates large vibration due to ignition driving, but durability to the vibration of the internal combustion engine can also improve.

Also, when the hole diameter of the boot leading end is larger than the outer diameter of the spring 70, a projection 101 is provided on an inside of the hole. The projection 101 has a function of centering the spring 70, and is particularly disposed outside in the bending direction. On the other hand, the spring diameter may be arbitrary except for the connection portion with the ignition plug. For that reason, a portion of the spring 70 disposed below the high voltage tower 41 can be reduced in diameter. This is advantageous in that not only the lightweight is enabled with a reduction in the material, but also a spring load and a resonance frequency can be freely designed and changed. However, the connection portion with the ignition plug needs to be designed according to the respective specifications of the plug hole and the ignition plug, and there is a possibility that the inner diameter of the boot leading end becomes larger than the spring diameter. Further, because of bending, the spring needs to be centered. However, the centering can be easily conducted by the projection 101.

Fourth Embodiment

Figure 5A:
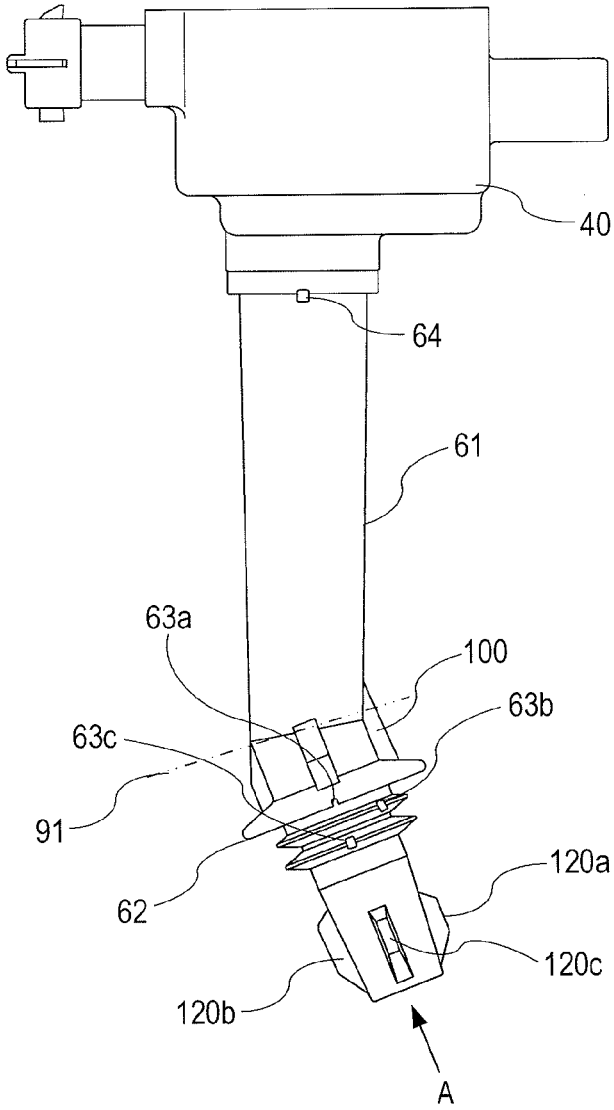
FIGS. 5A and 5B are diagrams illustrating an overall configuration of an ignition coil device according to a fourth embodiment of the present invention.
Figure 5B:
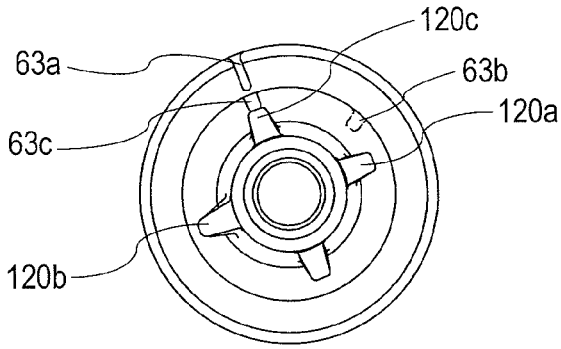

FIGS. 5A and 5B illustrate an ignition coil device according to a fourth embodiment of the present invention. In FIG. 5B, the boot leading end is viewed from an arrow A. When the ignition coil located in the plug hole operates, the ignition coil device is exposed to high temperature due to electric discharge of the ignition plug and heating of the internal combustion engine. For that reason, an external temperature is lower than the plug hole, a temperature difference between the outside and inside of the plug hole is very large, and further a pressure difference occurs therebetween. For that reason, in order to escape the heated air from the plug hole, air vents 63*a*, 63*b*, and 63*c* are opened. The positions of the air vents are not disposed in the outside direction of the bending but disposed in the inside direction. In FIGS. 5A and 5B, the air vents 63*a* and 63*c* are disposed substantially just in the center of the inside and outside of the bending direction, and the air vent 63*b* is disposed in the inside direction of the bending. However, with formation of the air vents, the temperature difference and the pressure difference are reduced whereas there is a risk of water entrance. Under the circumstances, because the positions of the air vents are arranged below with respect to the horizontal level in the outside direction of the bending, the air vents are disposed above, that is, in the inside direction of the bending for the purpose of preventing the water entrance.

Also, the respective air vents 63*a* to 63*c* are not linearly disposed, thereby preventing the water entrance. Further, the center axis of the air vents is formed in parallel to the center axis of the boot leading end. This facilitates formability of the boot leading end 62 having the air vents. Further, positioning members 64 are located on the boot base 61 close to the insulating case 40 and the insulating case 40. With this configuration, when assembling is conducted by inserting the boot leading end 62 into the insulating case 40, the positioning members 64 are aligned, whereby enabling assembling without an error of the bending direction. In a type in which the boot base 61 and the boot leading end 62 are not integral but separate, the positioning members 64 are located at positions close to both of the boot base 61 and the boot leading end 62 to enable the same advantages to be obtained.

As has been described above, the ignition coil device according to the present invention can be mounted in automobiles, two-wheel vehicles, outboard engines and the like, which mainly use the internal combustion engine, to improve the insertion property and the attachment and detachment property with respect to the internal combustion engine.

Various modifications and alterations of this invention will be apparent to those skilled in the art without departing from the scope and spirit of this invention, and it should be understood that this is not limited to the illustrative embodiments set forth herein.

What is claimed is:

1. An ignition coil device of a bent type, comprising:

a case having a transformer structure with a primary coil and a secondary coil therein;

a high voltage tower including a high voltage terminal that transmits a high voltage developed in the secondary coil to a lower portion of the case; and a plug boot that electrically and mechanically connects the high voltage terminal, the high voltage tower to an ignition plug, includes a boot base close to the high voltage tower and a boot leading end close to the ignition plug in which a center axis of the high voltage tower and a center axis of a boot leading end are tilted, wherein a bend position is set in the vicinity of an intersection point of the center axis of the high voltage tower and the center axis of the boot leading end, and a rigid intermediate member including a connection relay member that electrically connects the high voltage terminal and the ignition plug is provided, and the rigid intermediate member extends from the boot base to the bend position.

2. The ignition coil device according to claim 1, wherein an inner diameter of the rigid intermediate member close to at least the bend position is substantially identical with an outer diameter of the connection relay member.

3. The ignition coil device according to claim 1, wherein the connection relay member has a spring shape having coarse and dense portions, and are coarse at least the bend position.

4. The ignition coil device according to claim 1, wherein a plurality of insertion ribs are formed on a tip of the boot leading end, and the insertion ribs disposed outside in the bending direction are thicker, longer, or larger in the number than the insertion ribs disposed inside in the bending direction.

5. The ignition coil device according to claim 1, further comprising: a reinforcement rib formed on an exterior of the bend position of the plug boot.

6. The ignition coil device according to claim 1, wherein when an inner diameter of the boot leading end is larger than an outer diameter of the connection relay member, a projection is disposed outside in the bending direction on the inside of the hole of the boot leading end.

7. The ignition coil device according to claim 1, wherein an air vent is disposed in the boot leading end in an inside direction of the bending.

* * * * *